US012222179B2

(12) United States Patent
Paulson et al.

(10) Patent No.: US 12,222,179 B2
(45) Date of Patent: Feb. 11, 2025

(54) MODULAR DELINKER FOR MACHINE GUN

(71) Applicant: CHD Holdings, LLC, Nashville, TN (US)

(72) Inventors: Kristopher Lee Paulson, Hendersonville, TN (US); Matthew Steinhauser, Philadelphia, PA (US)

(73) Assignee: CHD HOLDINGS, LLC, Nashville, TN (US)

( * ) Notice: Subject to any disclaimer, the term of this patent is extended or adjusted under 35 U.S.C. 154(b) by 0 days.

(21) Appl. No.: 18/220,907

(22) Filed: Jul. 12, 2023

(65) Prior Publication Data

US 2024/0240889 A1 Jul. 18, 2024

Related U.S. Application Data

(60) Provisional application No. 63/439,116, filed on Jan. 14, 2023.

(51) Int. Cl.
*F41A 9/31* (2006.01)
*F41A 9/36* (2006.01)
*F41A 9/53* (2006.01)

(52) U.S. Cl.
CPC ..... *F41A 9/31* (2013.01); *F41A 9/36* (2013.01); *F41A 9/53* (2013.01)

(58) Field of Classification Search
CPC ..... F41A 9/30; F41A 9/31; F41A 9/36
See application file for complete search history.

(56) References Cited

U.S. PATENT DOCUMENTS

| | | | | |
|---|---|---|---|---|
| 6,443,044 | B1 * | 9/2002 | Dillon | F41A 9/36 89/12 |
| 9,506,705 | B1 * | 11/2016 | Fleischli | F41A 9/31 |
| 9,719,740 | B2 * | 8/2017 | Rowe | F41A 9/36 |
| 10,871,336 | B1 * | 12/2020 | Johnston | F41A 19/68 |
| 11,754,355 | B2 * | 9/2023 | Paulson | F41A 7/08 89/12 |
| 2019/0137204 | A1 * | 5/2019 | Abbott | F41A 9/36 |
| 2022/0364825 | A1 * | 11/2022 | Paulson | F41A 9/36 |

* cited by examiner

*Primary Examiner* — Bret Hayes
(74) *Attorney, Agent, or Firm* — Mark A. Pitchford; Eric B. Fugett; Pitchford Fugett, PLLC

(57) ABSTRACT

A machine gun (e.g., a minigun) is provided with a modular delinker. The front of the delinker (i.e., nose) can be removed from the main body of the delinker without tools. The paddle wheel in the main body includes a front paddle wheel and a rear paddle wheel. The front paddle wheel is removable from the main body with the nose, and the rear paddle wheel remains within the main body on a driven shaft of the delinker when the nose is removed from the main body. Thus, some components of the delinker are accessible and serviceable without tools, and the nose and front paddle wheel may be swapped out without tools out to alter a compatible ammunition cartridge type of the delinker. A jam can be cleared and damaged front and/or rear paddle wheels can be replaced in the field to return a gun to service.

20 Claims, 11 Drawing Sheets

MODULAR DELINKER FOR MACHINE GUN

CROSS-REFERENCES TO RELATED APPLICATIONS

This application claims priority to U.S. Provisional Patent Application No. 63/439,116 entitled "MODULAR DELINKER FOR MACHINE GUN" filed Jan. 17, 2023.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to machine guns (e.g., miniguns such as the M134). More particularly, this invention pertains to delinkers for machine guns utilizing linked ammunition cartridges.

Referring to prior art FIG. 1, a machine gun (e.g., an M134 minigun) 100 used in ground warfare and in helicopter or other aircraft warfare is a six-barrel electrically driven rotary machine gun. The machine gun 100 is conventionally powered by an external battery pack or power supply 105. The power supply (e.g., external battery or vehicle power system) 105 provides power to the minigun drive motor 107, solenoid 109, and booster motor 111. The M134 minigun 100 operates as an "on/off" machine upon activation by pulling the trigger or pressing a button switch 113. That is, the gun 100 operates at a fixed rate of fire. The gun may 100 be selectable between two fixed fire rates via a switch. That is, the gun 100 may have a high setting of 4000 rounds per minute and a low setting of 2000 rounds per minute, and the setting is selectable via a 2 position switch.

The conventional prior art machine gun 100 relies on an external battery pack 105 or power supply having electrical cables supplying power to the drive motor 107, to the solenoid 109 that activates the clutch 125, and to the booster motor 111. When the push button 113 is engaged, power is provided to the drive motor 107, the solenoid 109, and the booster motor 111 from the external power system 105. The drive motor 107 initiates the turning of the rotating barrel assembly 103. The solenoid 109 activates to mate the clutch gear to the feeder delinker assembly 121 (i.e. to the drive gear in the feeder delinker 121). The booster motor 111 begins advancing linked ammunition (e.g., a "chain" of ammunition) into the feeder delinker assembly 121 from an ammunition canister 106 via a sleeve 112. Powering all relevant parts of the gun 100 upon activation of the button 113 initiates the firing action of the gun 100. The delinker 121 provides de-linked ammunition to the barrel assembly 103 which fires each ammunition cartridge and discards spent ammunition casings. The barrel assembly 103 includes a plurality of rotating barrels, an action, and a housing configured to support the rotating components and optionally other components such as the delinker 121, main drive motor 107, gun control unit 113, and delinker clutch solenoid 109. The conventional minigun 100 operates on a fixed rate of fire operated by an on/off push button 113 or switch.

A conventional minigun 100 has a power cable that connects to the motor control unit (also known as a gun control unit), with two shorter cables connecting to the motor control or gun control unit to the motor 107 and the clutch solenoid 109. The booster motor 111 is also powered by the main power cable. The clutch solenoid 109 engages a clutch to drive the delinker from the main drive motor 107 when the gun is firing.

The delinker 121 includes a cast single piece housing. A paddle wheel of the delinker 121 is a single piece designed for a single ammunition cartridge type. Tools are required to disassemble the delinker 121 to clear jams or repair the delinker. If any component is damaged (such as during a major stoppage), replacement of the entire delinker assembly 121 is generally required, and the gun 100 is inoperable and not repairable until a replacement delinker 121 and tools become available. The gun 100 is thus very difficult to clear of malfunctions and repair in the field, especially under stress (i.e., in a combat situation).

BRIEF SUMMARY OF THE INVENTION

Aspects of the present invention provide a machine gun (e.g., a minigun) with a modular delinker. The front of the delinker (i.e., nose) can be removed from the main body of the delinker without tools. The paddle wheel in the main body includes a front paddle wheel and a rear paddle wheel. The front paddle wheel is removable from the main body with the nose, and the rear paddle wheel remains within the main body on a driven shaft of the delinker when the nose is removed from the main body. Thus, some components of the delinker are accessible and serviceable without tools, and the nose and front paddle wheel may be swapped out without tools out to alter a compatible ammunition cartridge type of the delinker. A jam can be cleared and damaged front and/or rear paddle wheels can be replaced in the field to return a gun to service.

In one aspect, a modular delinker for a machine gun includes a main body, paddle wheel, and a nose. The main body is configured to receive linked ammunition cartridges and separate and ammunition cartridge from the linked ammunition cartridges when the delinker is operating. The main body extends along a longitudinal axis. The paddle wheel is configured to receive the ammunition cartridge from the main body and provide the ammunition cartridge to a barrel assembly of the machine gun when the delinker is operating. The nose is configured to releasably engage the main body to retain the paddle wheel longitudinally within the main body when the delinker is assembled.

In another aspect, a machine gun includes a barrel assembly, a modular delinker, a main drive motor, and a gun control unit. The barrel assembly is configured to receive ammunition cartridges, by the ammunition cartridges and eject the spent casings from the ammunition cartridges. The main drive motor is configured to drive the barrel assembly and the delinker when the gun is assembled in firing. The gun control unit is configured to provide power to the main drive motor when the gun is assembled in firing. The modular delinker for a machine gun includes a main body, paddle wheel, and a nose. The main body is configured to receive linked ammunition cartridges and separate and ammunition cartridge from the linked ammunition cartridges when the delinker is operating. The main body extends along a longitudinal axis. The paddle wheel is configured to receive the ammunition cartridge from the main body and provide the ammunition cartridge to a barrel assembly of the machine gun when the delinker is operating. The nose is configured to releasably engage the main body to retain the paddle wheel longitudinally within the main body when the delinker is assembled.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein an upright position of the electrically driven rotary machine gun 100 is when fully assembled with the barrel assembly 103 (i.e., rotor assembly) ready to fire (or firing) in a generally horizontal orientation. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 1:
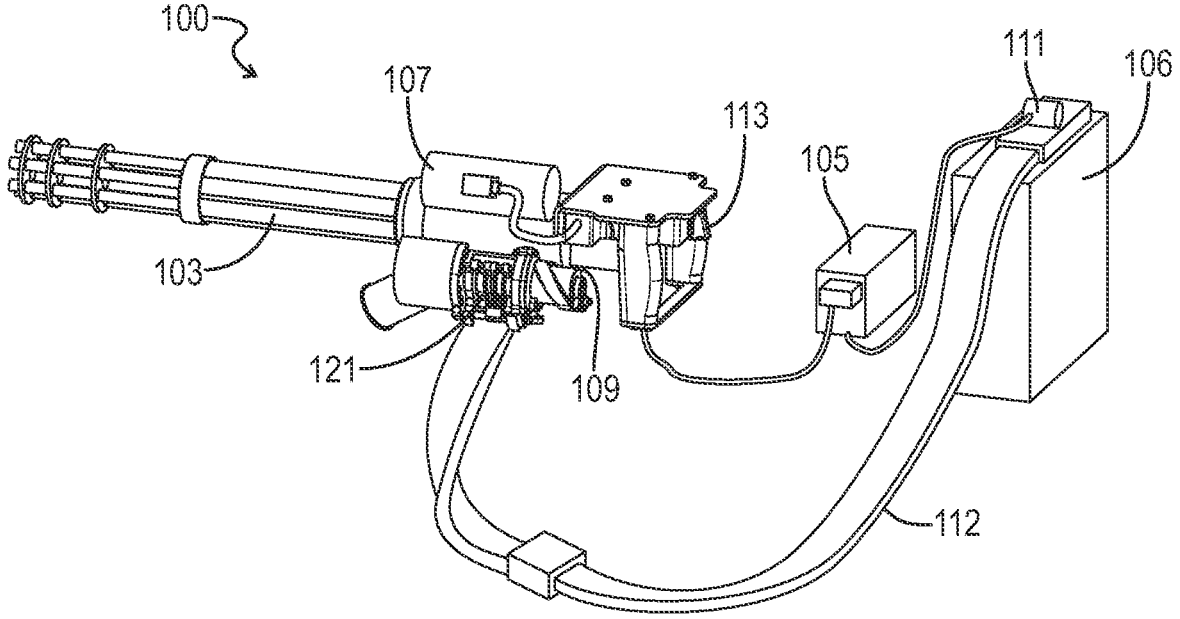
FIG. 1 (PRIOR ART)
FIG. 1 is a prior art machine gun, particularly a M134 minigun.
Figure 2:
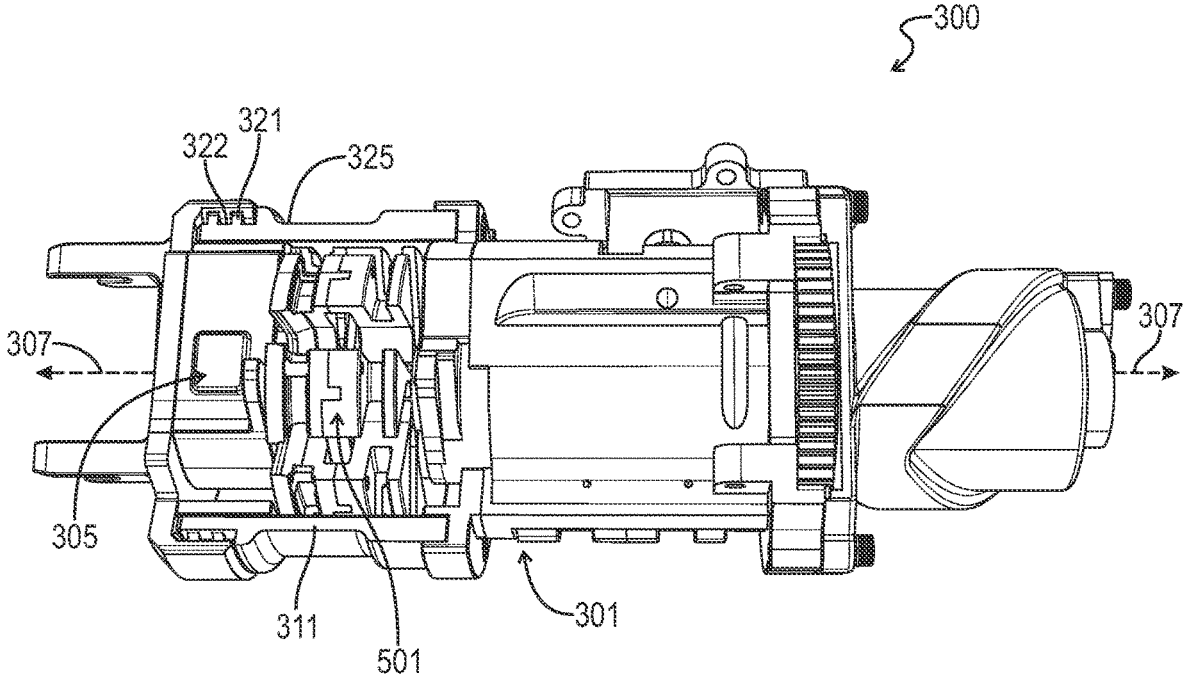
FIG. 2 is a top perspective view of one embodiment of a modular delinker for the machine gun of FIG. 1.
Figure 3:
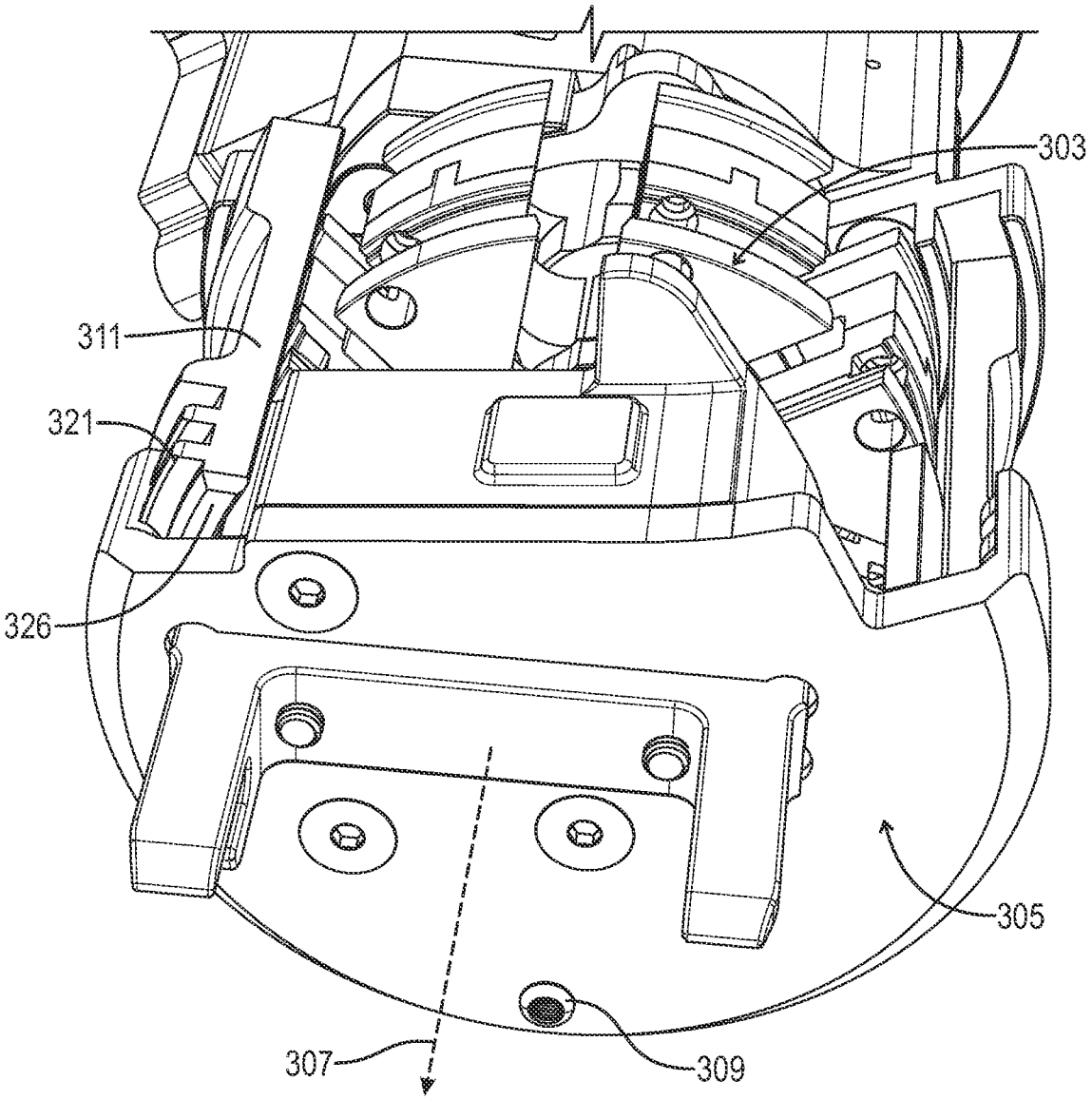
FIG. 3 is an elevated front perspective view of the delinker of FIG. 2.
Figure 4:
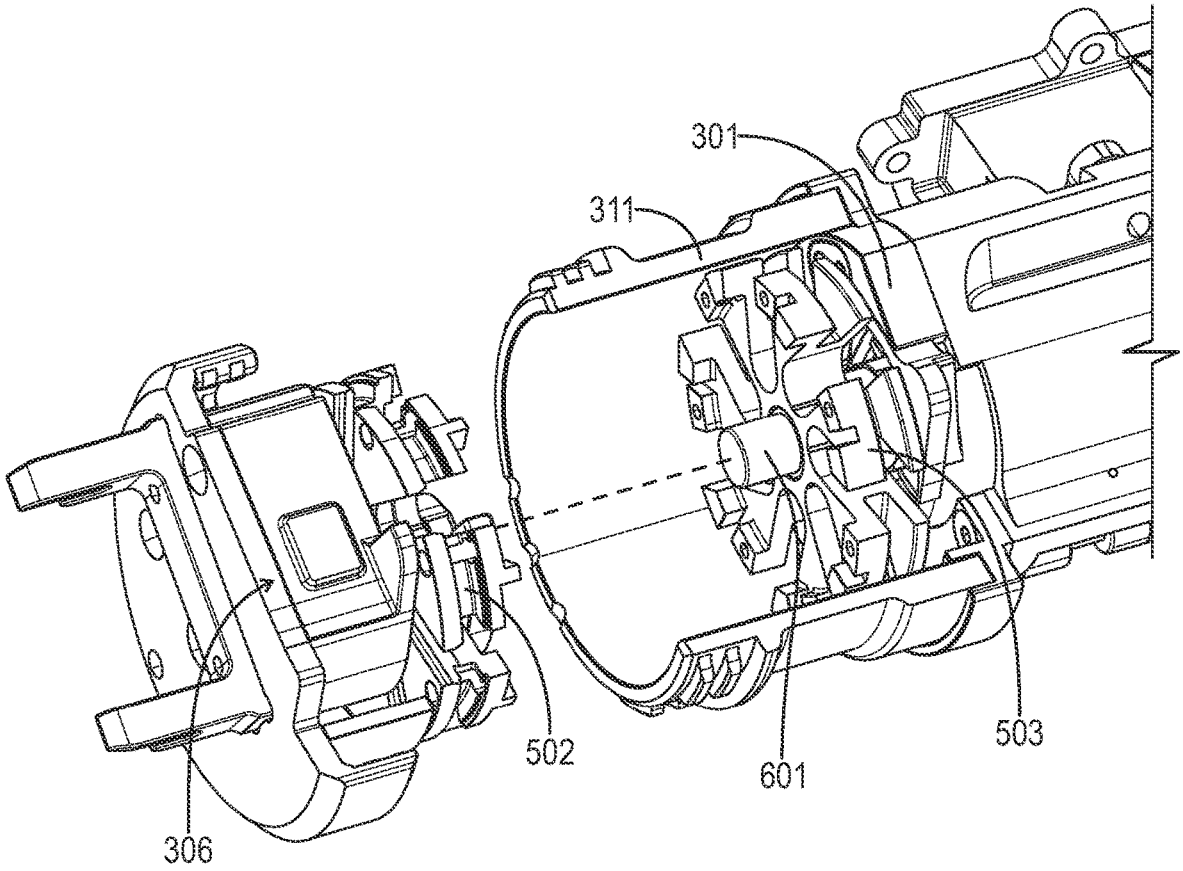
FIG. 4 is a partially exploded top perspective view of the delinker of FIG. 2 showing an alternative second nose and front paddle wheel.
Figure 5:
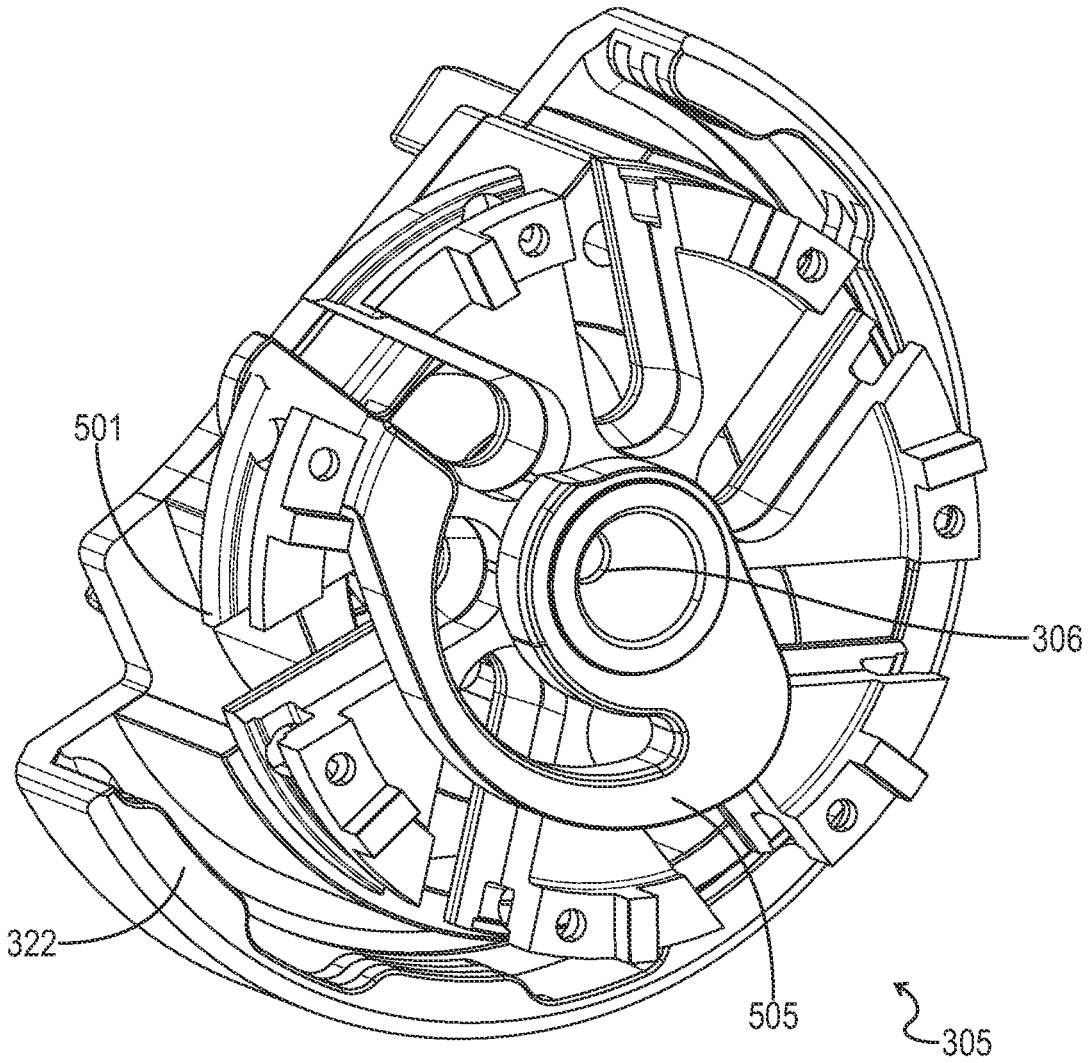
FIG. 5 is a rear perspective view of a nose of the delinker of FIG. 2.
Figure 6:
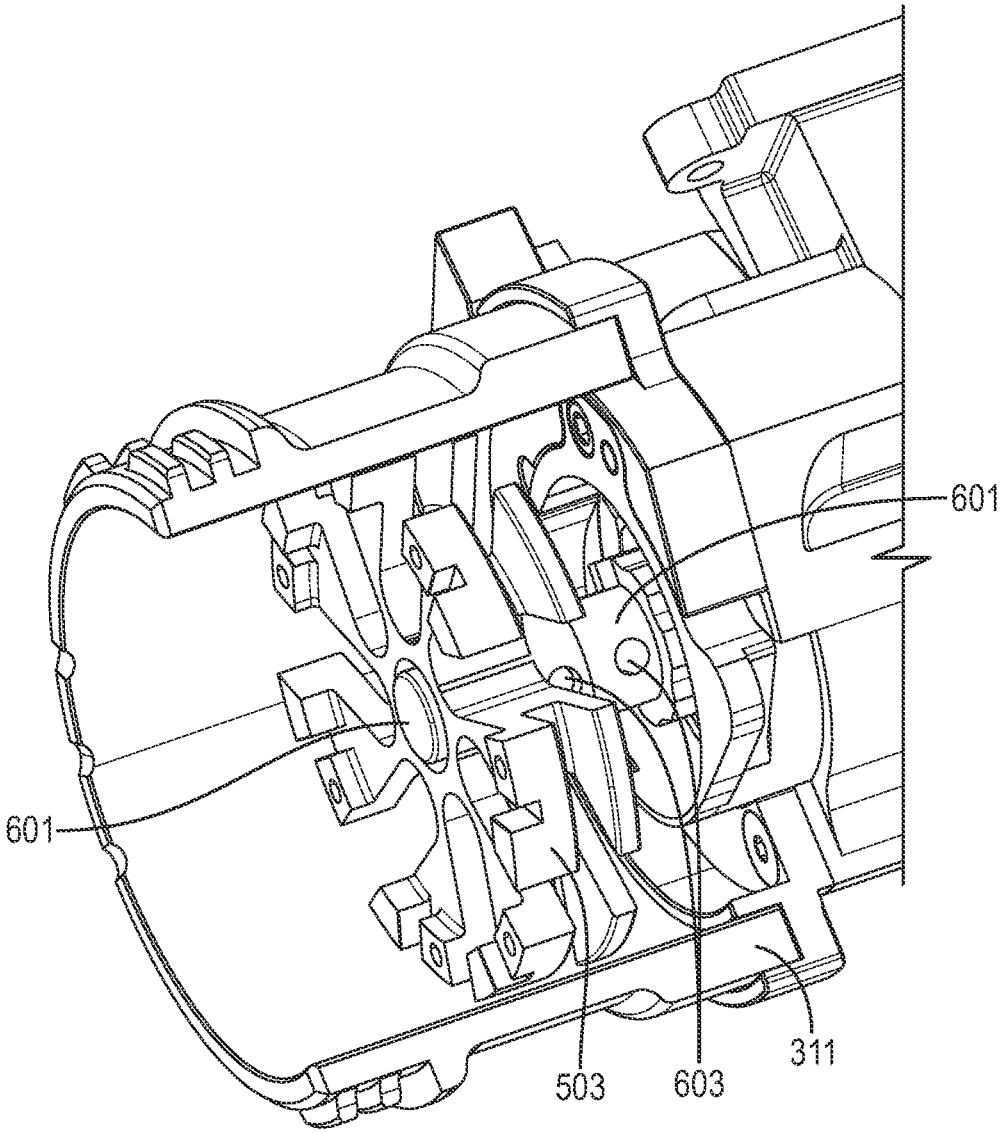
FIG. 6 is a partially exploded top perspective view of the delinker of FIG. 2 with a nose of the delinker removed and a rear paddle wheel moved forward slightly to expose a pin hole through the rear paddle wheel and a driven shaft of the delinker.
Figure 7:
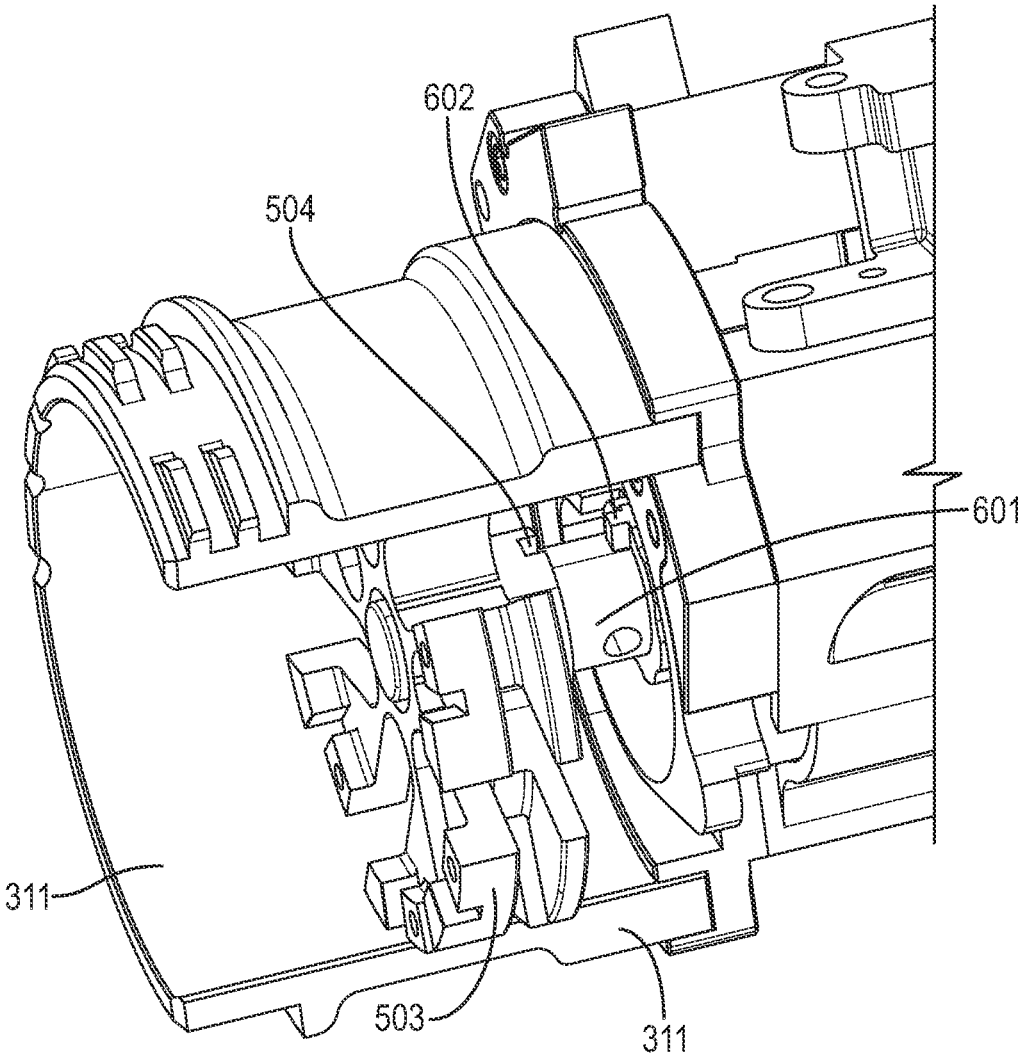
FIG. 7 is a partially exploded top perspective view of the delinker of FIG. 2 with a nose of the delinker removed and a rear paddle wheel moved forward slightly to expose a keyway in the rear paddle wheel and a key on the driven shaft of the delinker.
Figure 8:
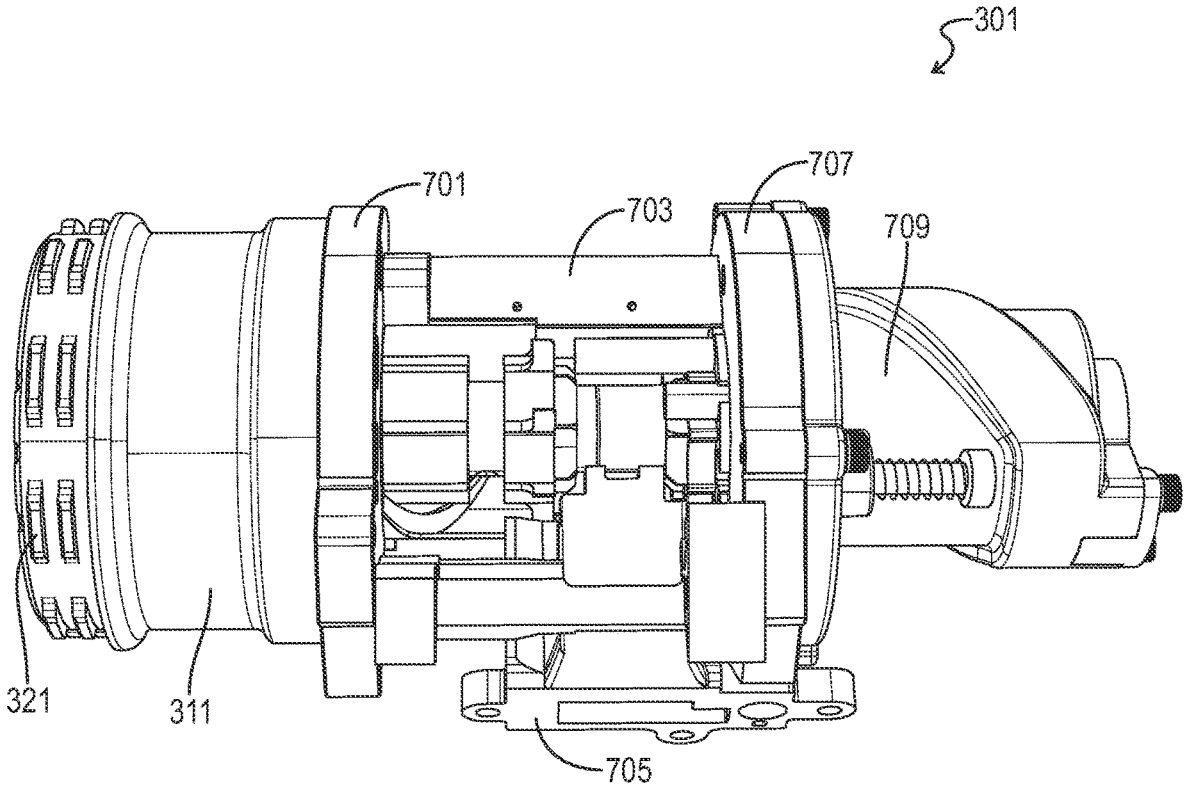
FIG. 8 is a bottom perspective view of the delinker of FIG. 2.
Figure 9:
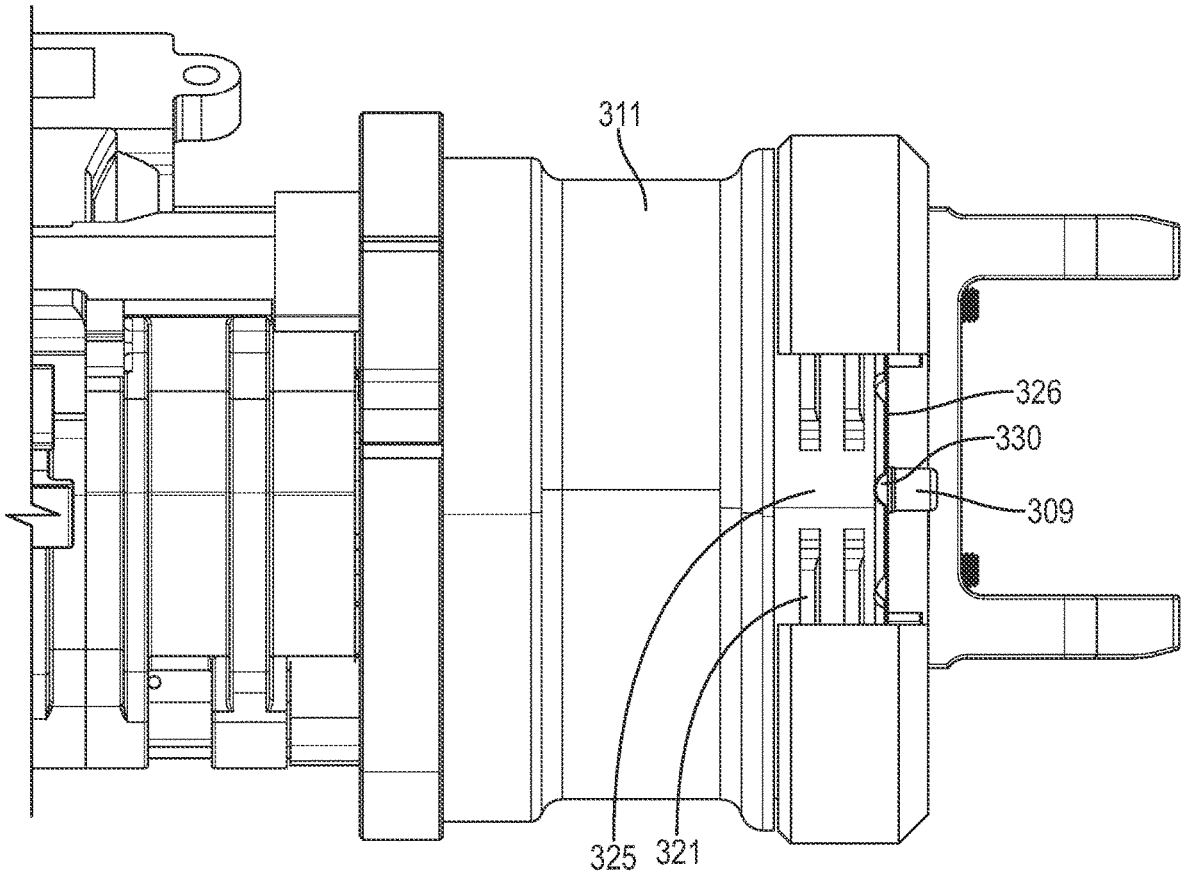
FIG. 9 is a bottom perspective view of the delinker of FIG. 2 with a partial cutaway of the nose to reveal a detent ball and detent clocking the nose to the main body.
Figure 10:
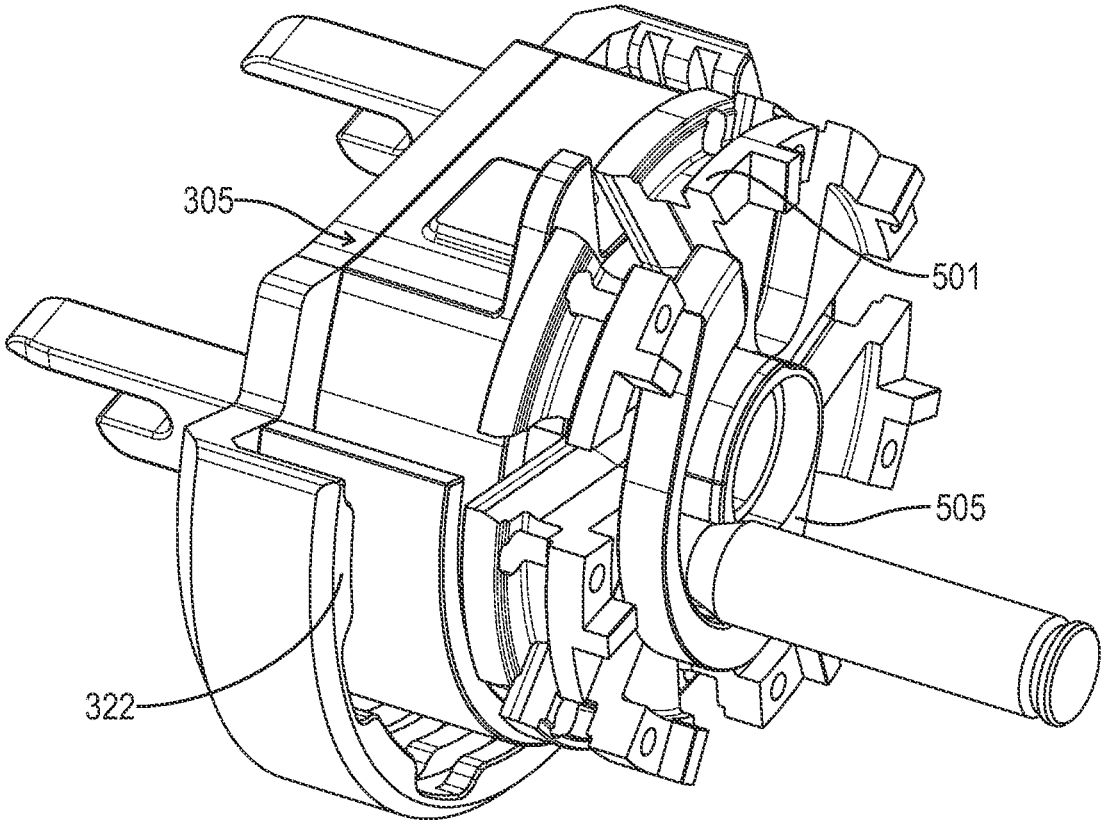
FIG. 10 is a rear isometric view of a nose of the delinker of FIG. 2 showing an ammunition cartridge beginning to engage with an eccentric cam and front paddle wheel of the delinker as the ammunition cartridge moves through the delinker in operation.
Figure 11:
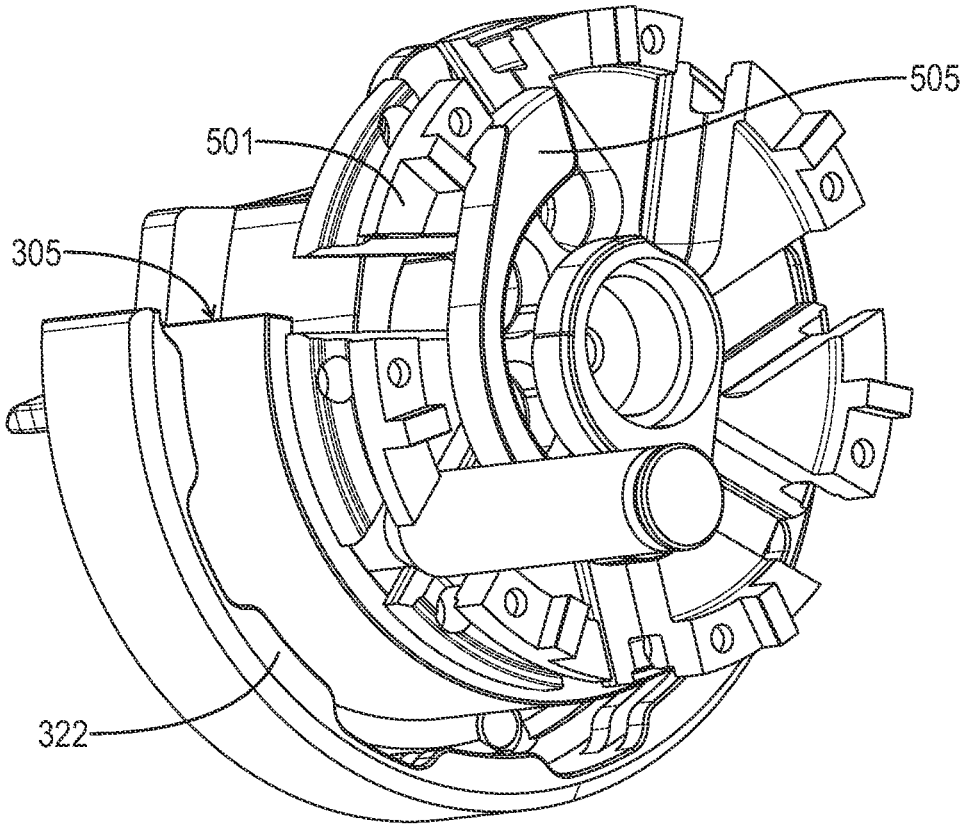
FIG. 11 is a rear isometric view of the nose of FIG. 9 showing the ammunition cartridge engaging with the eccentric cam and the front paddle wheel as the ammunition cartridge is prepared to depart the delinker for the barrel assembly of the machine gun.

Referring now to FIGS. 1-10, according to one embodiment of the invention, a machine gun 100 includes a barrel assembly, a modular delinker 300, a main drive motor 107, and the gun control unit 113. The barrel assembly 103 is configured to receive ammunition cartridges, fire the ammunition cartridges, and a check spent casings from the ammunition cartridges. The main drive motor 107 is configured to drive the barrel assembly 103 in the modular delinker 300 when the gun 100 is assembled in firing. The gun control unit 113 is configured to provide power to the main drive motor 107 when the gun 100 is assembled and firing. In one embodiment, the gun 100 also includes a booster motor 111, a sleeve 112, and a clutch solenoid 109. The booster motor 111 is configured to receive power from the power supply 105 via the gun control unit 113 when the gun 100 is firing. The booster motor 111 sends linked ammunition from the ammunition canister 106 to the delinker 300 when the gun 100 is firing. Sleeve 112 is configured to convey the linked ammunition from the booster motor 111 to the delinker 300 when the gun 100 is assembled in firing. The delinker 300 is driven by the drive motor 107 via the clutch solenoid 109 while the gun 100 is assembled and firing. In one embodiment, the nose 305 extends longitudinally forward of the main body 301 when the delinker 300 is assembled with the nose 305 engaging the main body 301.

In one embodiment, the modular delinker 300 includes a main body 301, a paddlewheel 303, and a nose 305. The main body 301 is configured to receive linked ammunition cartridges in separate and ammunition cartridge from the linked ammunition cartridges when the delinker 300 is operating. The main body 301 extends along a longitudinal axis 307. The forward direction of the longitudinal axis 307 is toward a muzzle of the gun 100 when the delinker 300 is assembled on the gun 100, and a rear direction of the longitudinal axis 307 is opposite the forward direction of the longitudinal axis 307. The paddlewheel 303 is configured to receive the ammunition cartridge from the main body 301 and provide the ammunition cartridge to the barrel assembly 103 of the gun 100 when the delinker 300 is operating. The nose 305 is configured to releasably engage the main body 301 to retain the paddlewheel 303 longitudinally within the main body 301 when the delinker 300 is assembled.

In one embodiment, the main body 301 includes a paddlewheel housing 311 configured to at least partially surround the paddlewheel 303 when the delinker 300 is assembled. The nose 305 releasably engages the paddlewheel housing 311 via a twist lock. In one embodiment, the twist lock is a series of interlocking lugs on the nose 305 and paddlewheel housing 311. In one embodiment, the interlocking lugs include main body lugs 321 spaced about an exterior surface 325 of the paddlewheel housing 311 at a forward end 326 of the paddlewheel housing 311. The interlocking lugs also include nose lugs 322 spaced about an interior surface 327 of the nose 305 at a rear end 328 of the nose 305. In one embodiment, the delinker 300 further includes a spring-loaded detent ball 309 and a detent 330. The detent ball 309 is in the nose 305, and the detent 330 is in the forward end 326 of the paddlewheel housing 311. The detent ball 309 is received in the detent 330 to maintain the nose 305 in a predetermined position with respect to the main body 301 during assembly of the delinker 300 and attachment of the delinker 300 to the barrel assembly 103.

In one embodiment, the paddlewheel 303 includes a front paddlewheel 501 in the rear paddlewheel 503. The nose 305 includes a nose shaft 306 extending along the longitudinal axis 307 when the delinker is assembled. The front paddlewheel 501 is retained on the nose shaft 306 such that when the nose 305 is disengaged from the main body 301 and removed from the paddlewheel housing 311, the front paddlewheel 501 is removed from the main body 301. In one embodiment, the paddlewheel 303 further includes an eccentric cam 505. The eccentric camp of 05 is also retained on the nose shaft 306 rearward of the front paddlewheel 501. The eccentric cam 505 is configured to direct a front of the ammunition cartridge forward and outward from the longitudinal axis 307 of the main body 301 into the front paddlewheel 501 as the ammunition cartridge moves through the delinker 300 to the barrel assembly 103.

In one embodiment, the delinker 300 further includes a driven shaft 601 extending through the rear paddlewheel 503 into the front paddlewheel 501 when the delinker 300 is assembled. The driven shaft 601 rotates the rear paddlewheel 503 when the delinker 300 is assembled and operating (e.g., when the gun 100 is firing). The rear paddlewheel 503 and the driven shaft 601 are configured to interlock with one another when the rear paddlewheel 503 is properly clocked to the driven shaft 601 and the delinker 300 is assembled. In one embodiment, the rear paddlewheel 503 is pinned to the driven shaft 601 such that the rear paddlewheel 503 is retained on the driven shaft 601 when the nose 305 is disengaged and removed from the main body 301. Pin holes 603 through the rear paddlewheel 503 and driven shaft 601 can be seen, for example, in FIG. 6. In one embodiment, the rear paddlewheel 503 and the driven shaft 601 include a complementary key 602 and keyway 504 that interlock with one another when the delinker 300 is assembled. In one embodiment, the front paddlewheel 501 and rear paddlewheel 503 are configured to interlock with one another when the front paddlewheel 501 is properly clocked to the rear paddlewheel 503 such that the rear paddlewheel 503 rotates the front paddlewheel 501 when the delinker 300 is assembled and operating. The front paddlewheel 501 and rear paddlewheel 503 include complementary keys and key ways to interlock with one another when the delinker 300 is assembled.

In one embodiment, the front paddlewheel 501 is a first front paddlewheel 501 having a first ammunition cartridge type (e.g., 7.62×51 mm) and the delinker are 300 includes a second nose 306 including a second front paddlewheel 502 having a second ammunition cartridge type (e.g., 6.8×51 mm). The first ammunition cartridge type is different from the second ammunition cartridge type. The delinker 300 is compatible with the first ammunition type when the first nose 305 is engaging the main body 301 and the delinker 300 is assembled. The delinker 300 is compatible with the second ammunition type when the first nose 305 is disengaged and removed from the main body 301 and the second nose 306 engages the main body 301 and the delinker 300 is thus assembled.

In one embodiment, the main body 301 of the delinker 300 includes a mid plate 701, the paddlewheel housing 311, a round positioner 703, a feed chute adapter 705, a rear plate 707, and a camming section 709. The paddlewheel housing 311 is attached to the mid plate 701 when the delinker 300 is assembled. The round positioner 703 is attached to the mid plate 701 when the delinker 300 assembled. The rear plate 707 is attached to the round positioner 703 when the delinker 300 is assembled. The camming section 709 is attached to the rear plate 707 when the delinker 300 is assembled. The feed chute adapter 705 is attached to the round positioner 703 when the delinker is assembled. Alternatively, the feed chute adapter 705 may be connected to any combination of the mid plate 701, the rear plate 707, and the round positioner 703. In this way, any damaged parts of the delinker 300 main body 301 may be replaced without replacing the entire modular delinker 300, and access to the internal parts of the main body 301 (e.g., the paddle wheel 303, drive gear, cams and palls is possible with simple tools (e.g., a hex key).

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MODULAR DELINKER FOR MACHINE GUN it is not intended that such references be construed as limitations upon the scope of this invention except as set forth in the following claims.

What is claimed is:

1. A modular delinker for a machine gun, said delinker comprising:

a main body configured to receive linked ammunition cartridges and separate an ammunition cartridge from the linked ammunition cartridges when the delinker is operating, wherein the main body extends along a longitudinal axis;

a paddle wheel configured to receive the ammunition cartridge from the main body and provide the ammunition cartridge to a barrel assembly of the machine gun when the delinker is operating; and a nose configured to releasably engage the main body to retain the paddle wheel longitudinally within the main body when the delinker is assembled wherein the main body comprises a paddle wheel housing configured to at least partially surround the paddle wheel when the delinker is assembled; and wherein the nose releasably engages the paddle wheel housing via a twist lock.

2. The modular delinker of claim 1, wherein:

the nose releasably engages the paddle wheel housing via interlocking lugs.

3. The modular delinker of claim 1, wherein:

the nose releasably engages the paddle wheel housing via interlocking lugs on the nose and the paddle wheel housing;

the interlocking lugs comprise main body lugs spaced about an exterior surface of the paddle wheel housing at a forward end of the paddle wheel housing;

the interlocking lugs comprise nose lugs spaced about an interior surface of the nose at a rear end of the nose;

the delinker further comprises a detent ball and a detent;

the detent ball is in the nose;

the detent is in the forward end of the paddle wheel housing of the main body; and the detent ball is received in the detent to maintain the nose in a predetermined position with respect to the main body during assembly of the delinker and attachment of the delinker to the barrel assembly.

4. The modular delinker of claim 1, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body.

5. The modular delinker of claim 1, wherein:

the paddle wheel comprises a front paddle wheel; a rear paddle wheel; and an eccentric cam;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body;

the eccentric cam is retained on the nose shaft rearward of the front paddle wheel, wherein the eccentric cam is configured to direct a front of the ammunition cartridge forward and outward from the longitudinal axis of the main body into the front paddle wheel as the ammunition cartridge moves through the delinker to the barrel assembly.

6. The modular delinker of claim 1, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body; and the delinker further comprises a driven shaft extending through the rear paddle wheel into the front paddle wheel when the delinker is assembled, wherein the driven shaft drives rotates the rear paddle wheel when the delinker is assembled and operating.

7. The modular delinker of claim 1, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body;

the delinker further comprises a driven shaft extending through the rear paddle wheel into the front paddle wheel when the delinker is assembled, wherein the driven shaft drives rotates the rear paddle wheel when the delinker is assembled and operating; and the rear paddle wheel and the driven shaft are configured to interlock with one another when the rear paddle wheel is properly clocked to the driven shaft and the delinker is assembled.

8. The modular delinker of claim 1, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body;

the delinker further comprises a driven shaft extending through the rear paddle wheel into the front paddle wheel when the delinker is assembled, wherein the driven shaft drives rotates the rear paddle wheel when the delinker is assembled and operating; and the rear paddle wheel is pinned to the driven shaft such that the rear paddle wheel is retained on the driven shaft when the nose is disengaged and removed from the main body.

9. The modular delinker of claim 1, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body;

the delinker further comprises a driven shaft extending through the rear paddle wheel into the front paddle wheel when the delinker is assembled, wherein the driven shaft drives rotates the rear paddle wheel when the delinker is assembled and operating; and the front paddle wheel and rear paddle wheel are configured to interlock with one another when the front paddle wheel is properly clocked to the rear paddle wheel such that the rear paddle wheel rotates the front paddle wheel when the delinker is assembled and operating.

10. The modular delinker of claim 1, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body;

the nose is a first nose and the front paddle wheel is a first front paddle wheel;

the delinker further comprises a second nose comprising a second nose shaft having a second front paddle wheel retained thereon, wherein:

the first front paddle wheel has a first ammunition cartridge type;

the second front paddle wheel has a second ammunition cartridge type; and the first ammunition cartridge type is different from the second ammunition cartridge type;

the delinker is compatible with the first ammunition type when the first nose is engaging the main body and the delinker is assembled; and the delinker is compatible with the second ammunition type when the first nose is disengaged and removed from the main body and the second nose engages the main body and the delinker is assembled.

11. The modular delinker of claim 1, wherein:

the nose extends longitudinally forward of the main body when the delinker is assembled with the nose engaging the main body.

12. The modular delinker of claim 1, wherein:

the main body comprises:

a mid plate;

a paddle wheel housing attached to the mid plate when the delinker is assembled;

a round positioner attached to the mid plate when the delinker is assembled;

a rear plate attached to the round positioner when the delinker is assembled; and a camming section attached to the rear plate when the delinker is assembled.

13. The modular delinker of claim 1, wherein:

the main body comprises:

a mid plate;

a paddle wheel housing attached to the mid plate when the delinker is assembled;

a round positioner attached to the mid plate when the delinker is assembled;

a rear plate attached to the round positioner when the delinker is assembled;

a camming section attached to the rear plate when the delinker is assembled; and a feed chute adapter attached to the round positioner when the delinker is assembled.

14. A machine gun comprising:

a barrel assembly configured to receive ammunition cartridges, fire the ammunition cartridges, and eject spent casings from the ammunition cartridges;

a modular delinker comprising:

a main body configured to receive linked ammunition cartridges and separate an ammunition cartridge from the linked ammunition cartridges when the delinker is operating, wherein the main body extends along a longitudinal axis;

a paddle wheel configured to receive the ammunition cartridge from the main body and provide the ammunition cartridge to the barrel assembly of the machine gun when the delinker is operating; and a nose configured to releasably engage the main body to retain the paddle wheel longitudinally within the main body when the delinker is assembled;

wherein the main body comprises a paddle wheel housing configured to at least partially surround the paddle wheel when the delinker is assembled; and wherein the nose releasably engages the paddle wheel housing via interlocking lugs;

a main drive motor configured to drive the barrel assembly and the delinker when the gun is assembled and firing; and a gun control unit configured to provide power to the main drive motor when the gun is assembled and firing.

15. The machine gun of claim 14 further comprising:

a booster motor configured to receive power from a power supply via the gun control unit when the gun is firing, wherein the booster motor sends the linked ammunition from the from an ammunition canister to the delinker when the gun is assembled and firing.

16. The machine gun of claim 14 further comprising:

a booster motor configured to receive power from a power supply via the gun control unit when the gun is firing, wherein the booster motor sends the linked ammunition from the from an ammunition canister to the delinker when the gun is assembled and firing; and a sleeve configured to convey the linked ammunition from the booster motor to the delinker when the gun is assembled and firing.

17. The machine gun of claim 14 further comprising:

a booster motor configured to receive power from a power supply via the gun control unit when the gun is firing, wherein the booster motor sends the linked ammunition from the from an ammunition canister to the delinker when the gun is firing;

a sleeve configured to convey the linked ammunition from the booster motor to the delinker when the gun is assembled and firing; and a clutch solenoid, wherein the delinker is driven by the drive motor via the clutch solenoid while the gun is assembled and firing.

18. The machine gun of claim 14, wherein:

the paddle wheel comprises a front paddle wheel and a rear paddle wheel;

the nose includes a nose shaft extending along the longitudinal axis when the delinker is assembled;

the front paddle wheel is retained on the nose shaft such that when the nose is disengaged from the main body and removed from the paddle wheel housing, the front paddle wheel is removed from the main body;

the delinker further comprises a driven shaft extending through the rear paddle wheel into the front paddle wheel when the delinker is assembled, wherein the driven shaft drives rotates the rear paddle wheel when the delinker is assembled and operating;

the rear paddle wheel and the driven shaft are configured to interlock with one another when the rear paddle wheel is properly cocked to the driven shaft and the delinker is assembled; and the delinker further comprises an eccentric cam retained on the nose shaft rearward of the front paddle wheel, wherein the eccentric camshaft is configured to direct a front of the ammunition cartridge forward and outward from the longitudinal axis of the main body into the front paddle wheel as the ammunition cartridge moves through the delinker to the barrel assembly.

19. A modular delinker for a machine gun, said delinker comprising:

a main body configured to receive linked ammunition cartridges and separate an ammunition cartridge from the linked ammunition cartridges when the delinker is operating, wherein the main body extends along a longitudinal axis;

a paddle wheel configured to receive the ammunition cartridge from the main body and provide the ammunition cartridge to a barrel assembly of the machine gun when the delinker is operating; and a nose configured to releasably engage the main body to retain the paddle wheel longitudinally within the main body when the delinker is assembled;

wherein the main body comprises a paddle wheel housing configured to at least partially surround the paddle wheel when the delinker is assembled; and wherein the nose releasably engages the paddle wheel housing via interlocking lugs.

20. A modular delinker for a machine gun, said delinker comprising:

a main body configured to receive linked ammunition cartridges and separate an ammunition cartridge from the linked ammunition cartridges when the delinker is operating, wherein the main body extends along a longitudinal axis;

a paddle wheel configured to receive the ammunition cartridge from the main body and provide the ammunition cartridge to a barrel assembly of the machine gun when the delinker is operating; and a nose configured to releasably engage the main body to retain the paddle wheel longitudinally within the main body when the delinker is assembled;

wherein the paddle wheel comprises a front paddle wheel and a rear paddle wheel;

wherein the nose includes a nose shaft extending along the longitudinal axis when the delinker is assembled; and wherein the front paddle wheel is retained on the nose shaft such that when the nose is disengaged from the main body and removed from the paddle wheel housing, the front paddle wheel is removed from the main body.

* * * * *